US010556727B2

(12) United States Patent
Urteaga

(10) Patent No.: US 10,556,727 B2
(45) Date of Patent: Feb. 11, 2020

(54) FOOD CONTAINER AND RELATED METHODS

(71) Applicant: Ramon Andres Urteaga, Merion Station, PA (US)

(72) Inventor: Ramon Andres Urteaga, Merion Station, PA (US)

( * ) Notice: Subject to any disclaimer, the term of this patent is extended or adjusted under 35 U.S.C. 154(b) by 154 days.

(21) Appl. No.: 15/847,057

(22) Filed: Dec. 19, 2017

(65) Prior Publication Data

US 2019/0185223 A1 Jun. 20, 2019

(51) Int. Cl.

| | |
|---|---|
| ***B65D 43/06*** | (2006.01) |
| ***B65D 1/34*** | (2006.01) |
| ***B65D 51/24*** | (2006.01) |
| ***B65D 43/16*** | (2006.01) |
| ***B65D 81/22*** | (2006.01) |

(52) U.S. Cl.

CPC ..... *B65D 43/065* (2013.01); *B65D 1/34* (2013.01); *B65D 43/06* (2013.01); *B65D 43/161* (2013.01); *B65D 43/162* (2013.01); *B65D 51/24* (2013.01); *B65D 81/22* (2013.01); *B65D 2543/00194* (2013.01); *B65D 2543/00296* (2013.01)

(58) Field of Classification Search

CPC ..... B65D 1/34; B65D 21/023; B65D 21/02; B65D 81/3453; B65D 1/36

USPC ..... 206/501, 509, 541, 562, 565

See application file for complete search history.

(56) References Cited

U.S. PATENT DOCUMENTS

| | | | | |
|---|---|---|---|---|
| 8,317,024 | B1 * | 11/2012 | Persi | B65D 81/3205 206/508 |
| 9,078,535 | B1 * | 7/2015 | Buck | A47G 19/2205 |
| 9,181,009 | B1 * | 11/2015 | Buck | A47G 19/2272 |
| 2008/0264947 | A1 * | 10/2008 | Morenstein | B65D 43/161 220/376 |
| 2010/0044377 | A1 * | 2/2010 | Porter | B65D 51/2828 220/212 |
| 2010/0072100 | A1 * | 3/2010 | Henry | A47J 47/01 206/459.5 |
| 2013/0140209 | A1 | 6/2013 | Kim | |
| 2014/0103044 | A1 * | 4/2014 | Ramsey | B65D 43/0231 220/367.1 |
| 2014/0339233 | A1 * | 11/2014 | King | B65F 1/16 220/367.1 |
| 2015/0329265 | A1 * | 11/2015 | Birgen | B65D 51/28 206/204 |
| 2017/0225844 | A1 * | 8/2017 | Prakailerdluk | B65D 21/0217 |
| 2017/0253406 | A1 * | 9/2017 | Wallander | B65D 77/2084 |
| 2019/0045957 | A1 * | 2/2019 | Patterson | A47J 47/14 |

* cited by examiner

*Primary Examiner* — Shawn M Braden
(74) *Attorney, Agent, or Firm* — The Law Offices of Ramón A. Urteaga

(57) ABSTRACT

A container for food includes a tray and a lid. with the lid extending between first and second longitudinal ends. The lid has one or more sidewalls, as well as a top wall that is connected to the one or more sidewalls, with the top wall having an interior surface that faces an interior of the container. The top wall also includes an exterior surface that is disposed opposite the interior surface. The one or more sidewalls of the lid include an end wall that is located at the first longitudinal end of the lid, and the interior surface includes an end portion adjacent the end wall. The lid has at least one of a preformed raised portion on the exterior surface, or a deployable element for defining a raised portion on the exterior surface.

20 Claims, 7 Drawing Sheets

FOOD CONTAINER AND RELATED METHODS

TECHNICAL FIELD

The present disclosure is generally related to food containers, and more specifically to portable food containers for sushi and similar items.

SUMMARY

In one embodiment, a container for food is provided. The container includes a tray and a lid, with the tray having a tray surface that is configured to support a plurality of food items thereon. The lid is configured for releasable coupling with the tray to thereby define an interior of the container, with the lid extending between first and second longitudinal ends. The lid has one or more sidewalls, as well as a top wall that is connected to the one or more sidewalls, with the top wall having an interior surface that faces the interior of the container. The top wall also includes an exterior surface that is disposed opposite the interior surface. The one or more sidewalls of the lid include an end wall that is located at the first longitudinal end of the lid, and the interior surface includes an end portion adjacent the end wall.

The lid has at least one of a preformed raised portion on the exterior surface of the top wall, or a deployable element for defining a raised portion on that exterior surface. The raised portion is shaped and located in the lid such that, when the lid is flipped upside down and the exterior surface of the top wall is allowed to rest on a flat surface, at least a portion of the interior surface longitudinally located between the raised portion and the end wall is oriented so as to define an acute angle relative to the flat surface, measured exteriorly of the lid.

In a specific embodiment, the raised portion is shaped and located in the lid such that, when the lid is flipped upside down and the exterior surface is allowed to rest on a flat surface, the end portion of the top wall interior surface is oriented so as to define an acute angle relative to the flat surface, measured exteriorly of the lid. The raised portion may be movable between an undeployed position in which the exterior surface of the top wall of the lid is generally flat, and a deployed position in which the exterior surface of the top wall of the lid is not generally flat.

In embodiments having a movable raised portion, that raised portion may include a portion of each of a pair of sidewalls of the lid, with those portions of the pair of sidewalls of the lid being joined to a remainder of the lid through a respective pair of frangible lines. Additionally, the raised portion may be hingedly coupled to a remainder of the lid. In one aspect of particular embodiments, the raised portion is shaped and located in the lid such that, when the lid is flipped upside down and the exterior surface is allowed to rest on a flat surface, the end wall is oriented at an acute angle of less than about 85 degrees relative to the flat surface, with that angle being measured exteriorly of the lid.

The end wall and the end portion of the top wall interior surface, in certain embodiments, jointly define a liquid-holding volume of at least about 10 mL with a depth of at least about 4 mm when the lid is flipped upside down and the exterior surface of the lid's top wall is allowed to rest on a flat surface. In certain embodiments also, the end portion of the top wall interior surface defines a depression of the top wall interior surface relative to a remainder of the top wall interior surface. The lid may be designed such that, when the lid is flipped upside down and the exterior surface of the top wall is allowed to rest on a flat surface, the end portion of the top wall interior surface is generally parallel to the flat surface.

The raised portion may define a protrusion that extends from a remainder of the exterior surface of the top wall. Additionally or alternatively, the raised portion may be located adjacent the second longitudinal end of the lid. Further, the lid in certain embodiments includes at least two raised portions on the exterior surface of the top wall, both located adjacent the second longitudinal end of the lid, or in specific embodiments spaced from that second longitudinal end. In other embodiments, the raised portion may be defined by an inclined surface that extends from the second longitudinal end of the lid. In a specific embodiment, the top wall exterior surface has a stepped profile that includes at least a first step that defines the raised portion. In embodiments having a stepped profile, the first step may extend from the second longitudinal end of the lid. Additionally or alternatively, the top wall exterior surface may be shaped so as to have a number of contacting surfaces with the flat surface when the lid is flipped upside down and the exterior surface is allowed to rest on the flat surface, with the number of contacting surfaces being sufficient to substantially prevent the lid from rocking.

In another embodiment, a sushi container is provided that includes a tray having a tray surface configured to support a plurality of sushi items thereon. The sushi container also includes a lid that is configured for releasable coupling with the tray, to thereby jointly define an interior of the sushi container. The lid has one or more sidewalls and a top wall that is connected to the one or more sidewalls. The top wall has an interior surface that faces the interior of the sushi container, as well as an exterior surface that is disposed opposite the interior surface, with the one or more sidewalls including an end wall that is located at a first longitudinal end of the lid. The lid has at least one of a preformed raised portion on the exterior surface of the top wall of the lid, or a deployable element for defining a raised portion on that exterior surface.

The raised portion is shaped and located in the lid such that, when the lid is flipped upside down and the exterior surface is allowed to rest on a flat surface, the end wall and an end portion of the top wall interior surface adjacent the end wall are both oriented so as to define an acute angle relative to the flat surface, measured exteriorly of the lid, and such that the end wall and the end portion of the top wall interior surface jointly define a holding volume for soy sauce of at least about 10 mL with a depth of at least about 4 mm. The top wall exterior surface may be shaped so as to have a number of contacting surfaces with the flat surface when the lid is flipped upside down and the exterior surface is allowed to rest on the flat surface, with the number of contacting surfaces being sufficient to substantially prevent that lid from rocking. In a specific embodiment, the exterior surface includes an elongated channel that is configured to support a pair of chopsticks therein.

In yet another embodiment, a lid is provided for use with a tray to enclose food items. The lid includes one or more sidewalls, as well as a top wall that is connected to the one or more sidewalls. The top wall of the lid has an interior surface delimited by the one or more sidewalls, and an exterior surface disposed opposite the interior surface. The one or more sidewalls include an end wall that is located at a first longitudinal end of the lid. The lid also includes at least one of a preformed raised portion on the exterior surface or a deployable element for defining a raised portion on the exterior surface. The raised portion is shaped and located in the lid such that, when the lid is flipped upside down and the exterior surface is allowed to rest on a flat surface, at least a portion of the interior surface longitudinally located between the raised portion and the end wall is oriented so as to define an acute angle relative to the flat surface, measured exteriorly of the lid.

BRIEF DESCRIPTION OF THE DRAWINGS

The objectives and features of the invention will become more readily apparent from the following detailed description taken in conjunction with the accompanying drawings in which.

DETAILED DESCRIPTION OF PARTICULAR EMBODIMENTS

To the extent that any meaning or definition of a term in this written document conflicts with any meaning or definition of the term in a document incorporated by reference, the meaning or definition assigned to the term in this written document shall govern. Also, it is to be understood that the phraseology and terminology used herein is for the purpose of description and should not be regarded as limiting. The use of "including," "comprising," or "having," and variations thereof herein is meant to encompass the items listed thereafter and equivalents thereof as well as additional items. Unless specified or limited otherwise, the terms "mounted," "connected," "supported," "coupled," and variations thereof are used broadly and encompass both direct and indirect mountings, connections, supports, and couplings. Further, "connected" and "coupled" are not restricted to physical or mechanical connections or couplings. Also, as used herein, the term "releasable coupling" and related terms refer to a type of coupling in which the coupled structures may be readily detached, decoupled, or otherwise separated from one another in a simple manner and without causing the destruction or damage of any of those structures. For sake of further explanation, a permanent—rather than "releasable"—type of coupling may refer, for example, to two structures that are integrally formed with one another, or which are adhesively attached, such that their separation would necessarily result in at least some level of damage to one or more of the parts being separated.

Figure 1:
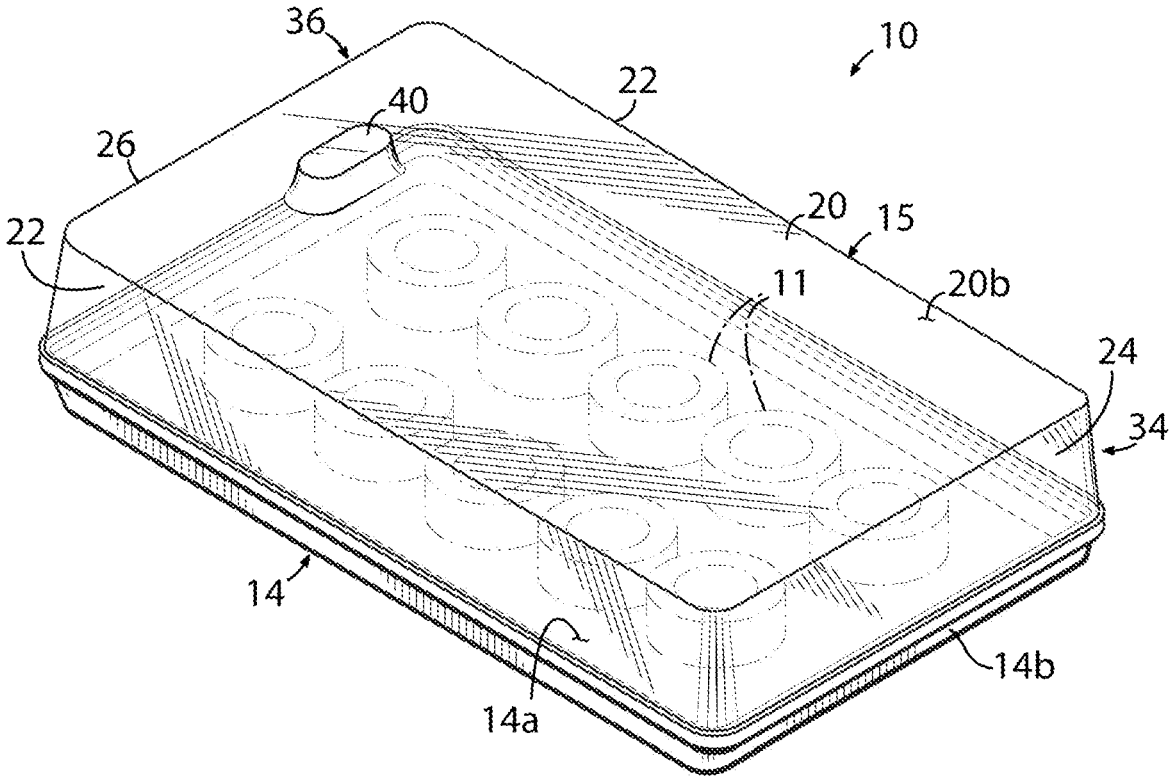
FIG. 1 is a perspective view of a container for food in accordance with one embodiment of the invention.
Figure 2:
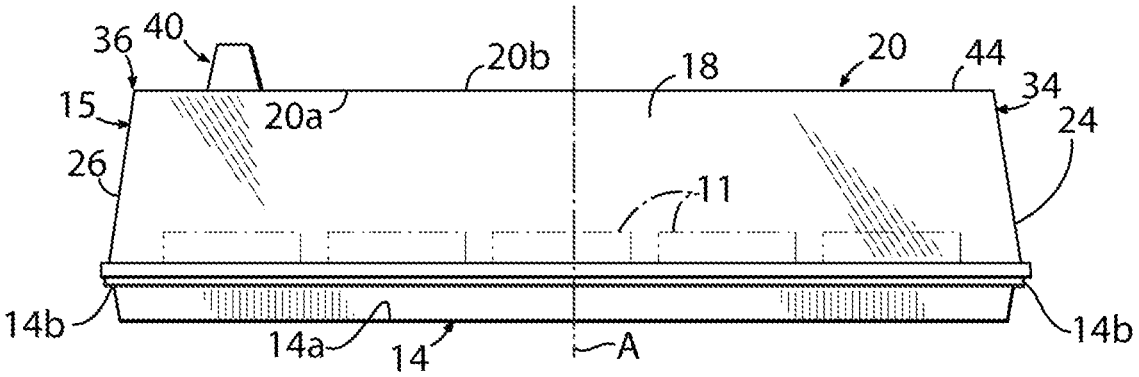
FIG. 2 is a side elevation view of the container of FIG. 1.
Figure 3:
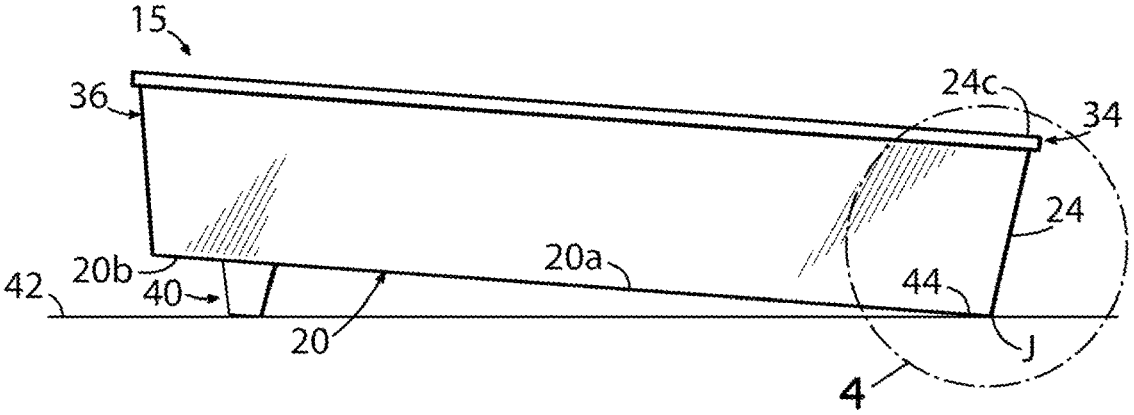
FIG. 3 is a side elevation view of a lid of the container of FIGS. 1 and 2 turned upside down relative to the view of FIG. 2.

With reference to the figures, and particularly to FIGS. 1, 2, and 3, an illustrative container 10 for food is shown, which could for example be suitable to hold and serve sushi items 11 such as nigiri, sashimi, or combinations thereof. Container 10 is made up of a tray 14 and a lid 15, which have respective dimensions and are made of materials that permit selective, releasable coupling with and decoupling from one another. As described more fully below, the lid 15 has features that permit that lid 15 to act, when flipped upside down, as a dipping tray for soy sauce or other liquid condiments that typically accompany sushi or other food items.

Tray 14 has a generally rectangular profile—as seen from above—and includes a tray surface 14*a* that partially defines an interior 18 of container 10. Tray surface 14*a* may have a smooth surface, a textured surface, or any other type of surface suitably chosen to allow sushi or other food items to rest thereon. The example tray 14 also has slightly raised end projections extending from a periphery of tray 14 and defining a set of walls 14*b*, although alternative embodiments are contemplated in which the tray has no projections of this type at all, or has well-defined walls defining respective angles with the tray surface that approach about 90 degrees or greater, with that angle being measured interiorly of the tray 14. Tray 14 is made of a suitably chosen material or combination of materials such as a translucent or opaque thermoplastic material, and further a thermoplastic material that is considered safe for contacting food items. The chosen material may also be a biodegradable material, such as a compostable plant-based material. One suitable material for tray 14 is polyethylene terephthalate (PETE), although that material is identified herein as a mere example, rather than in limiting fashion.

Lid 15 may be made of a material or combination of materials similar to or different from the material or materials of which tray 14 is made. For example, a container 10 is contemplated having a tray 14 made up of a material or combination of materials making tray 14 opaque, and a lid 15 made up of a material or combination of materials making lid 15 substantially transparent, which may be desirable to allow the sushi or other food items stored in interior 18 of container 10 to be visible to the exterior.

Lid 15 is made up of a top wall 20, as well as a plurality of sidewalls extending downward—in the orientation shown in FIGS. 1 and 2—from top wall 20. The sidewalls of lid 15 include a pair of oppositely disposed lateral walls 22, as well as oppositely disposed first and second end walls 24, 26 at respective first and second longitudinal ends 34, 36 of lid 15. Top wall 20 includes an interior surface 20*a* laterally delimited by the lateral walls 22 and longitudinally by the end walls 24, 26. The interior surface 20*a* partially defines interior 18 of container 10 and thereby faces—when tray 14 and lid 15 are fully coupled to one another—the sushi or other food items 11 stored in interior 18. An exterior surface 20*b* of top wall 20 is disposed opposite the interior surface 20*a*, and faces away from the food items stored in interior 18 when the tray 14 and lid 15 are coupled to one another.

Exterior surface 20*b* of top wall 20 has, in one example embodiment, at least one preformed raised portion that defines an asymmetrical profile of that exterior surface 20*b*, when comparing opposite sides of a transverse midline A of container 10 when seen from the side (as in FIG. 2). In the illustrated embodiment, and with particular reference to FIG. 3, exterior surface 20*b* has a single raised portion 40 that is shaped and located in lid 15 such that, when lid 15 is flipped upside down and exterior surface 20*b* is allowed to rest on a flat surface, the first end wall 24 as well at least an adjacent portion of the interior surface 20*a* of top wall 20 are angled relative to the flat surface. As used herein the term "upside down" refers to the orientation of lid 15 that is opposite from the conventional orientation of lid 15 when tray 14 and lid 15 are fully coupled to one another so as to store food items in interior 18.

FIG. 3 shows an example upside down orientation of lid 15, with exterior surface 20*b* resting on a flat, horizontal surface 42, which may for example be the top, eating surface of a table or counter. In the example embodiment in that figure, raised portion 40 is located proximal longitudinal end 36 of lid 15 such that, in the shown orientation, end wall 24 at the opposite longitudinal end 34 is angled relative to flat surface 42. Further, in that orientation, an end portion 44 of interior surface 20*a*, adjacent end wall 24 and longitudinally located in the lid 15 between raised portion 40 and end wall 24, is also angled relative to flat surface 42. End wall 24 may be oriented at a substantially right angle relative to adjacent end portion 44 of interior surface 20*a*, or may alternatively be oriented at an angle that is greater or less than about 90 degrees relative to end portion 44. An angle greater than about 90 degrees may be desirable, for example, to make the lid 15 stackable with other similar lids. In the embodiment shown in FIGS. 1-3, end wall 24 is oriented at angle that is greater than 90 degrees relative to end portion 44, although that is not intended to be a limiting example.

Figure 4:
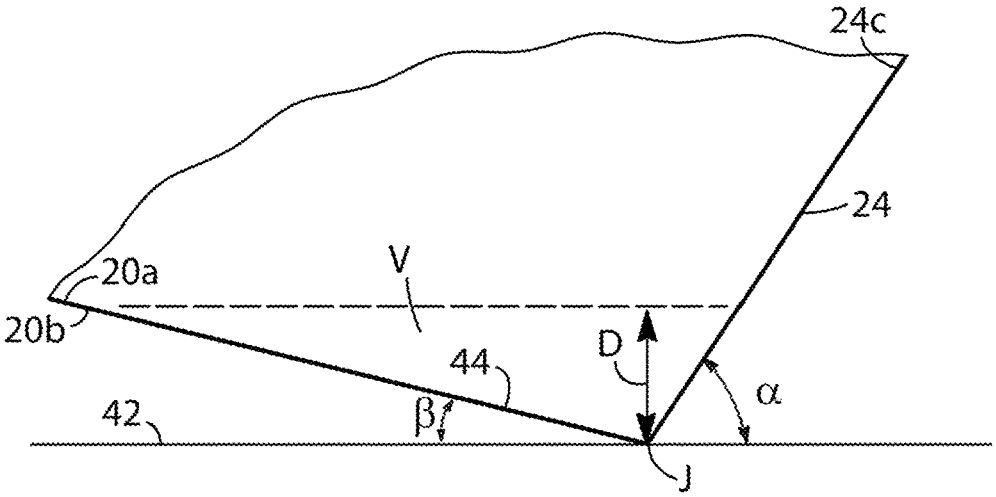
FIG. 4 is an enlarged, schematic view of a portion of encircled area 4 of FIG. 3.
Figure 5:
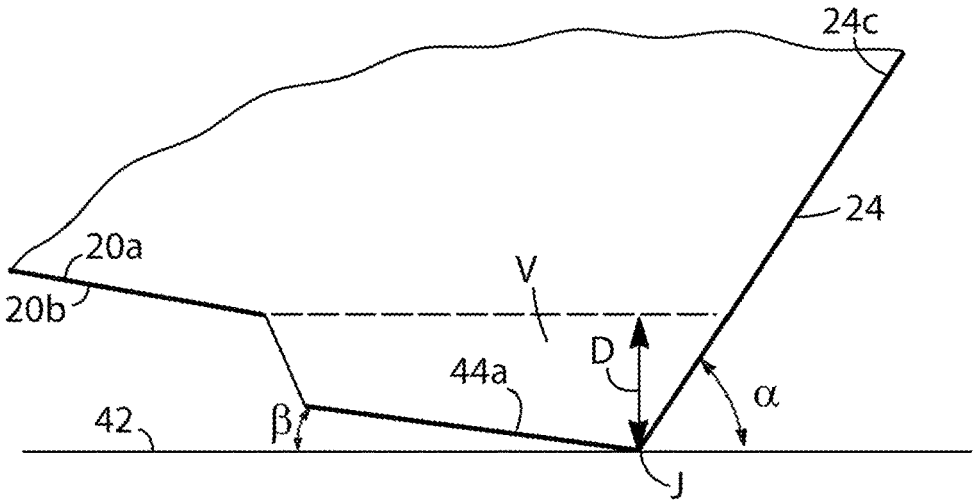
FIG. 5 is a view similar to FIG. 4, illustrating a portion of a lid in accordance with another embodiment of the invention.

With continued reference to FIGS. 1-3, and further referring to FIGS. 4 and 5, in the orientation of lid 15 in the illustrative embodiment of FIG. 3, end wall 24 and end portion 44 jointly define a liquid-holding volume V of lid 15 of at least about 10 mL at a depth D of at least about 4 mm. A volume of 10 mL corresponds to the total volume of soy sauce provided by two typical portable packets of soy sauce. A depth D of about 4 mm has been found to be a depth that permits sufficient level of dipping of a sushi item into the soy sauce held between end wall 24 and end portion 44. The depth of the holding volume V, as used herein, refers to the length of a straight, vertical line starting at the intersection J of end wall 24 and end portion 44 and ending at the surface of the liquid held in volume V. Referring particularly to FIG. 4, the liquid-holding volume V refers to the maximum volume available for holding liquid, defined by the end wall 24 and end portion 44, without the liquid spilling over the distal edge 24*c* of end wall 24. A variation of the above-described embodiment is shown in FIG. 5, in which interior surface 20*a* of top wall 20 has an end portion 44*a*—similar to end portion 44 of FIGS. 3 and 4, and also longitudinally located between raised portion 40 and end wall 24, but which defines a depression relative to a remainder of interior surface 20*a*. A depressed end portion such as end portion 44*a* may be desirable in order to maximize the size of the liquid-holding volume V.

In the embodiments of FIGS. 3-5, when the exterior surface 20*b* of top wall 20 rests on flat surface 42, the shape, dimensions, and location of raised portion 40 (FIG. 3) are such that end wall 24 and end portion 44, 44*a* are both angled relative to flat surface 42. Specifically, in those embodiments, end wall 24 is oriented at an acute angle $\alpha$ relative to flat surface 42, with that angle being measured exteriorly of lid 15, as shown in FIGS. 4 and 5. Angle $\alpha$ may be less than about 85 degrees, and more specifically less than about 80 degrees, or even less than about 75 degrees, for example. Likewise, end portion 44, 44*a* is oriented at an acute angle $\beta$ relative to flat surface 42, with that angle also being measured exteriorly of lid 15. Angle $\beta$ may be greater than about 5 degrees, and more specifically greater than 10 degrees, or even greater than about 15 degrees, for example. The orientations of end wall 24 and end portion 44, 44*a*, as well as the shape and disposition of raised portion 40 are suitably chosen so that angles $\alpha$ and $\beta$ provide a level of inclination of lid 15 effective to allow a suitable sized holding volume V to form, having the liquid holding capacity and depth discussed above.

In the upside-down orientation of example lid 15 shown in FIGS. 3-5, the exterior surface 20*b* of top wall 20 rests in stable fashion on flat surface 42, to thereby allow the user to have a stable liquid-holding volume V into which to pour a liquid condiment such as soy sauce. This may be desirable, for example, to prevent lid 15 from rocking between two different positions while holding soy sauce in liquid-holding volume V, which would otherwise potentially cause the soy sauce to inadvertently spill or splash onto the user's body or even onto flat surface 42. To that end, the exterior surface 20*b* may be designed to have a chosen number of contacting surfaces with flat surface 42 sufficient to substantially prevent any such rocking motion of lid 15. In the illustrated embodiments, for example, exterior surface 20*b* contacts flat surface 42 at the raised portion 40, as well as along the entirety of the juncture J of end wall 24 and end portion 44, 44*a*, which spans the transverse dimension (i.e., the width in the illustrated embodiment) of lid 15.

Figure 6:
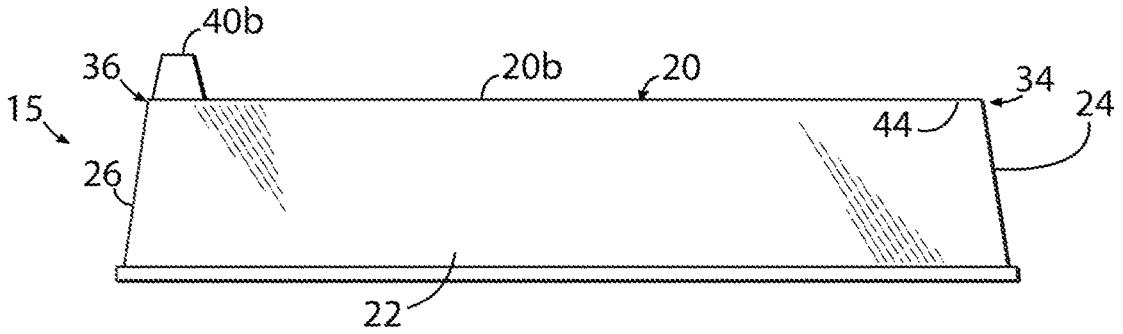
FIG. 6 is a side elevation view of a lid in accordance with another embodiment of the invention.
Figure 7:
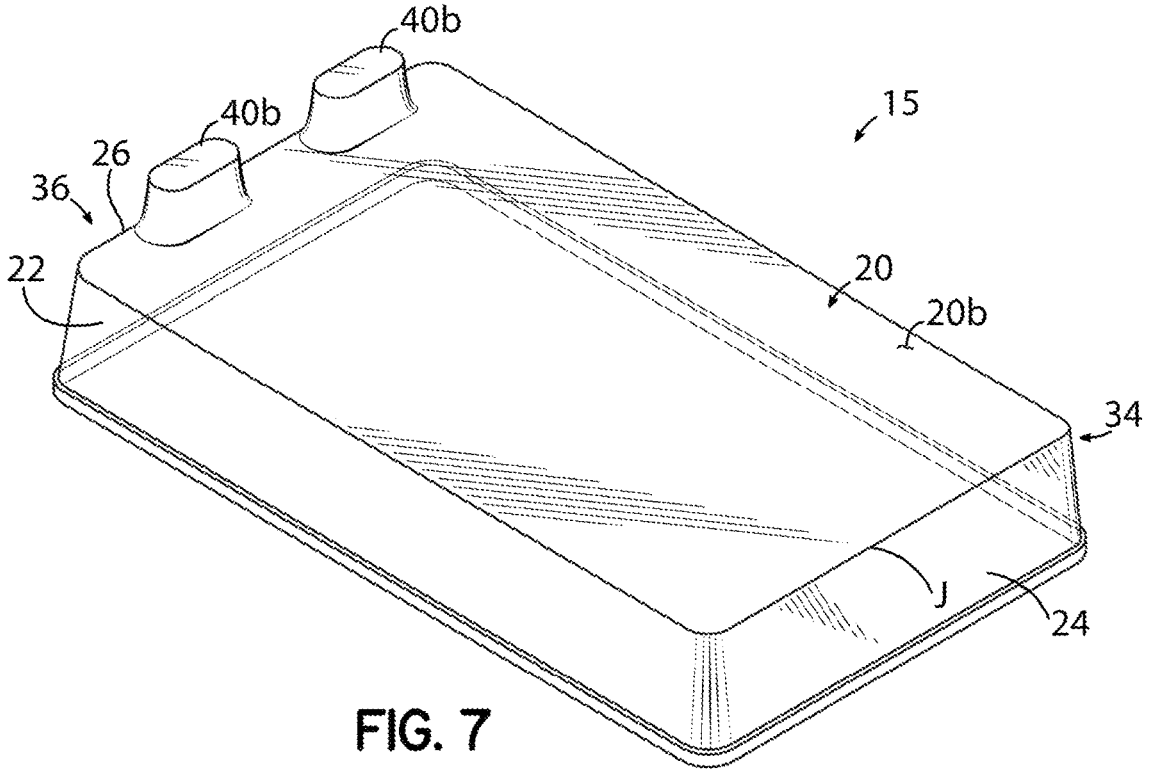
FIG. 7 is a perspective view of a container for food in accordance with yet another embodiment of the invention.

With continued reference to FIGS. 1-5, and referring further to FIGS. 6-12, in which like reference numerals refer to similar features in the preceding figures, the preformed raised portion of exterior surface 20*b* may take on various forms and be present in different numbers, all of which are contemplated within the scope of the present disclosure. In the embodiments of FIGS. 1-5, for example, the exterior surface 20*b* of lid 15 has a raised portion 40 in the form of a protrusion extending from a remainder of exterior surface 20*b*. FIG. 6 shows another embodiment, in which exterior surface 20*b* has a raised portion 40*b* similar to raised portion 40 in the embodiments of FIG. 1-5, but located adjacent the second longitudinal end 36 of lid 15, rather than being spaced from longitudinal end 36. FIG. 7 shows yet another embodiment, similar to that of FIG. 6, in which exterior surface 20*b* includes two raised portions 40*b*, both located adjacent the second longitudinal end 36 of lid 15.

Figure 8:
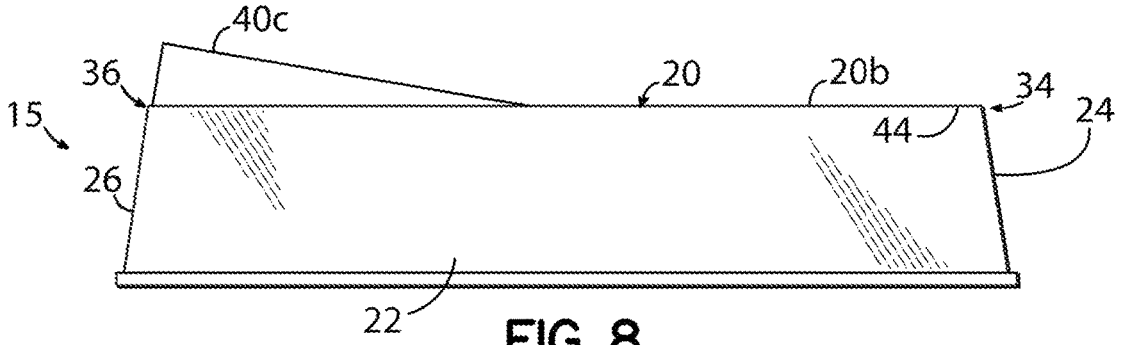
FIG. 8 is a side elevation view of a lid in accordance with another embodiment of the invention.
Figure 9:
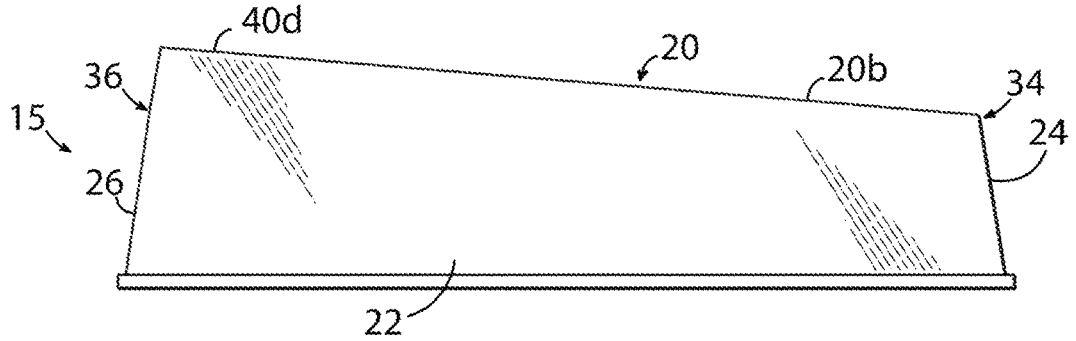
FIG. 9 is a view similar to FIG. 8, illustrating another embodiment of the invention.

With particular reference to FIG. 8, that figure illustrates another embodiment. In that embodiment, the exterior surface 20*b* has an inclined raised portion 40*c* that extends downward (with reference to the orientation of that figure) from the second longitudinal end 36 of lid 15 and ends in a generally central part of lid 15. A variation of that embodiment is illustrated in FIG. 9, in which lid 15 also has an inclined raised portion 40*d* that extends downward from the second longitudinal end 36, but which ends at the first longitudinal end 34. In the embodiment of FIG. 9, the exterior surface (the top surface in the orientation shown in the figure) of raised portion 40*d* itself defines the entirety of exterior surface 20*b* of top wall 20. Alternatively, raised portion 40*d* may be a portion that is built on top of another layer making up top wall 20.

Figure 10:
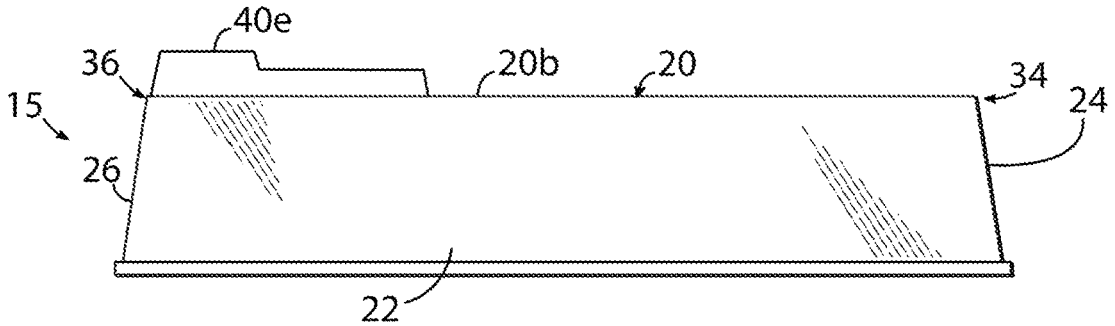
FIG. 10 is a view similar to FIGS. 8 and 9, illustrating yet another embodiment of the invention.

In yet another embodiment, shown in FIG. 10, the top wall 20 of lid 15 has a stepped profile, which includes a first step defining a raised portion 40*e* that extends from second longitudinal end 36. In any of the embodiments of FIGS. 1-10, the raised portion(s) may span the entire transverse dimension (e.g., width) of lid 15, or may alternatively span only a portion of that dimension. Further, in any of those embodiments, the raised portion(s) may be formed above another wall defining top wall 20, or may alternatively define the top wall 20 in and of itself. In contemplated embodiments of the latter type, accordingly, the interior surface 20*a* (FIGS. 1-5) would follow the profile of the raised portions in those embodiments.

Figure 11:
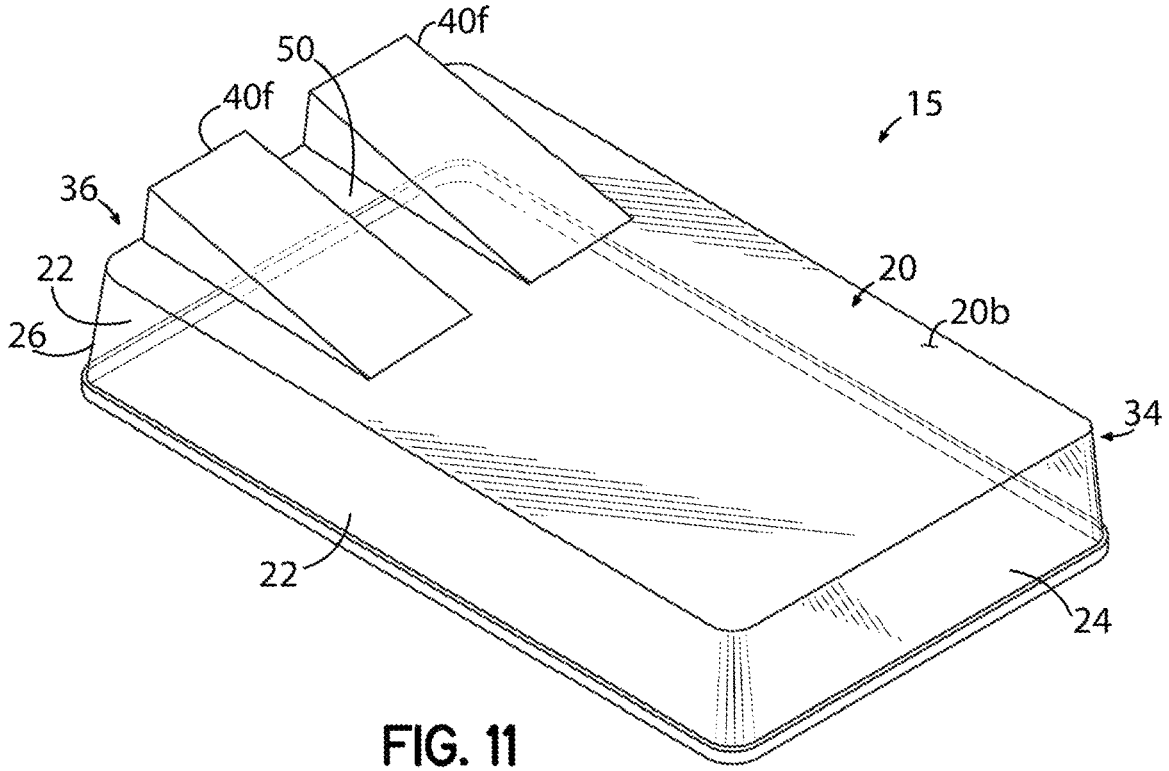
FIG. 11 is a perspective view of a container for food in accordance with another embodiment of the invention.
Figure 12:
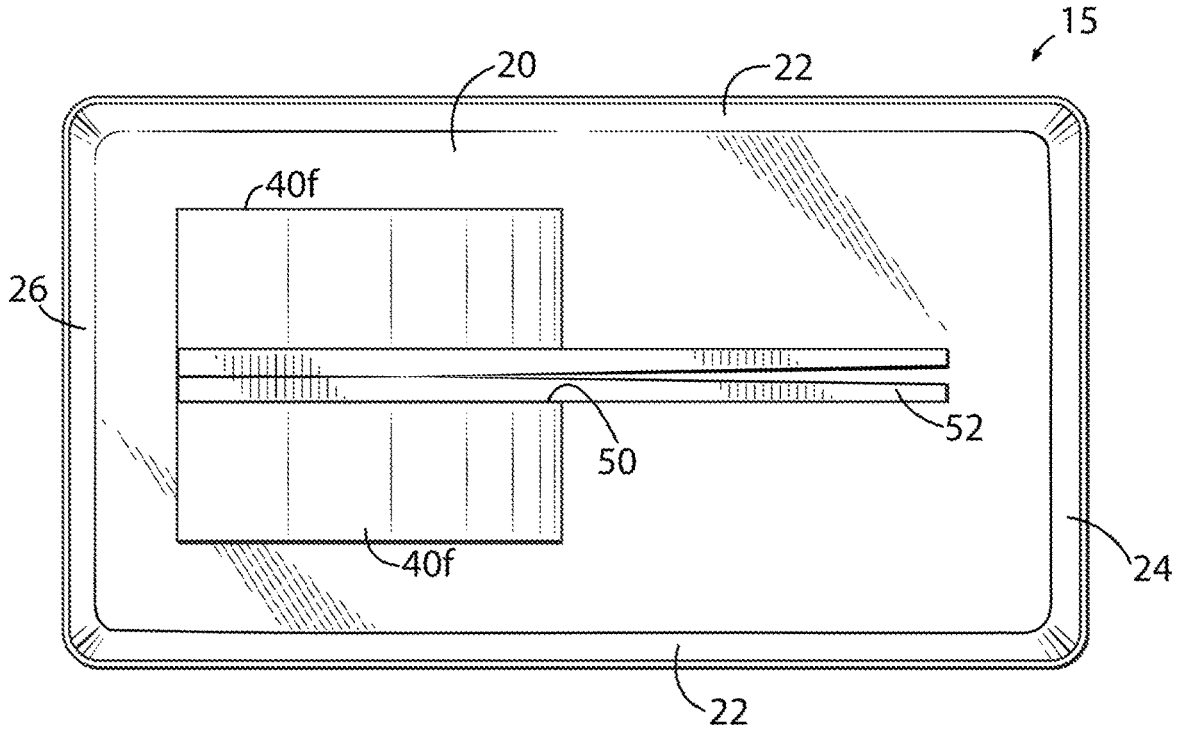
FIG. 12 is a top view of the container of FIG. 11.

FIGS. 11 and 12 show another embodiment, having two spaced-apart inclined raised portions 40*f*, both of which extend from second longitudinal end 36 and end in a generally central part of lid 15, and disposed so as to define an elongated depression or channel 50 in between. The size of channel 50 is chosen so as to tightly accommodate and frictionally retain a pair of chopsticks 52 (FIG. 12), which may be provided with container 10 (FIGS. 1-2) when container 10 is used to store sushi items, for example. Channel 50 may, for example and without limitation, have a width dimension of from about 5 mm to about 10 mm, to provide a snug fit for chopsticks 52. Alternative embodiments are contemplated in which raised portions having the functionality of raised portions 40*f* in the embodiment of FIGS. 11-12 have other shapes similar to or different from the example raised portions in the preceding embodiments.

Figure 13:
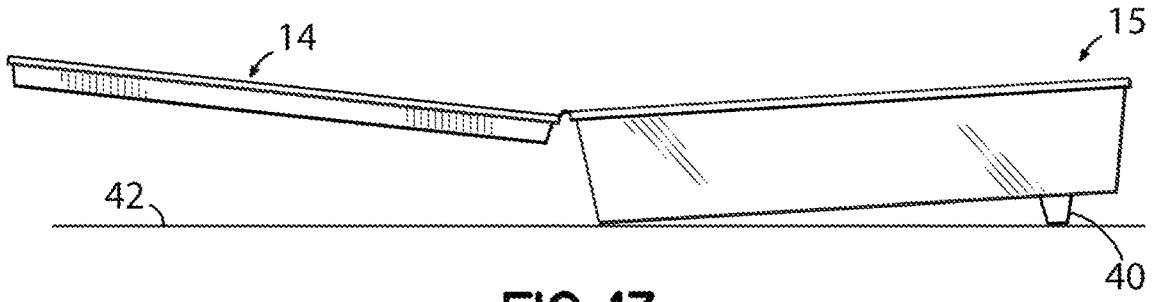
FIG. 13 is a side elevation view of a container for food in accordance with another embodiment of the invention.

While all of the above-described embodiments have a tray 14 and lid 15 that have a generally rectangular shape (as seen from above), it is contemplated that tray 14 and lid 15 may alternatively have other regular or irregular geometric shapes. Likewise, it is contemplated that tray 14 and lid 15 may be at least partially permanently joined to one another even when container 10 is in an open condition, as illustrated in FIG. 13, with cooperating portions of tray 14 and lid 15 being releasably coupled to one another when in a closed condition (FIGS. 1 and 2).

Figure 14:
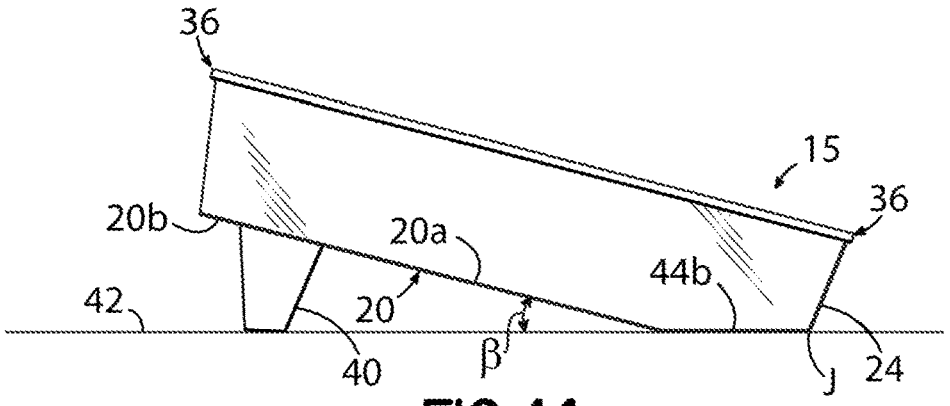
FIG. 14 is a side elevation view of a lid of a container for food in accordance with another embodiment of the invention.

FIG. 14 illustrates yet another embodiment, in which the interior surface 20*a* of lid 15 has an end portion 44*b*—adjacent end wall 24—that has a generally horizontal orientation i.e., parallel to horizontal flat surface 42 in that figure when exterior surface 20*b* is allowed to rest on flat surface 42. Like-reference numerals in FIG. 14 refer to similar features in the preceding embodiments, the description of which may be referred to for an understanding of the structure and function of each such feature in the embodiment of FIG. 14 as well. In that embodiment, the remainder of interior surface 20*a*, including the portion of interior surface 20*a* longitudinally located between raised portion 40 and end wall 24, and more specifically between raised portion 40 and end portion 44*b*, is angled relative to flat surface 42 so as to define an acute angle β relative to flat surface 42, measured exteriorly of lid 15. A generally horizontal orientation of end portion 44*b* may be desirable in order to provide the user with a flat bottom surface for liquid-holding volume V, rather than a generally V-shaped bottom surface, as in the embodiments in FIGS. 3-5, for example. In the illustrative embodiment of FIG. 14, end portion 44*b* is generally parallel to the flat surface 42 and the lid 15 has a single raised portion 40, similar to the like-numbered raised portion in the embodiment of FIGS. 1-3. The exterior surface 20*b* of lid 15 may alternatively have one or more raised portions taking the form of any of the raised portions described above in connection with other embodiments, adjacent or spaced from the second longitudinal end 36.

Figure 15:
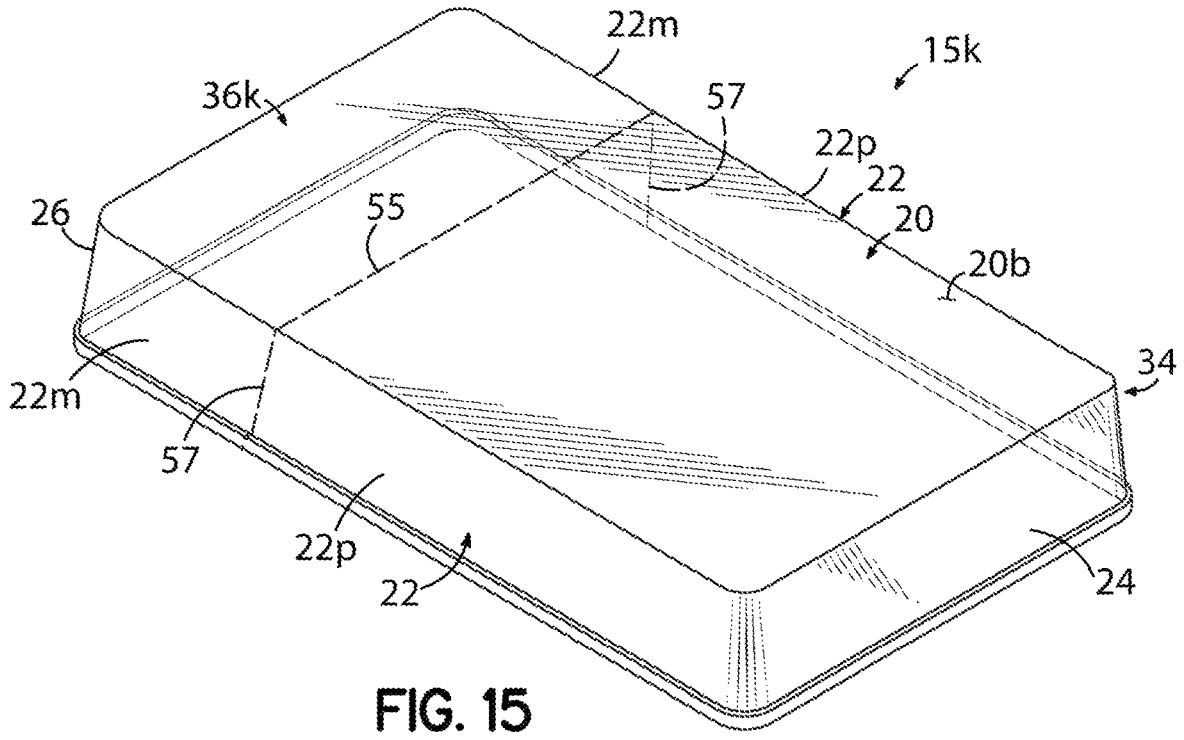
FIG. 15 is a perspective view of a lid of a container for food in accordance with yet another embodiment of the invention.

Referring now to FIG. 15, in which like reference numerals refer to similar features in the preceding figures, another embodiment is illustrated in which the raised portion of the lid is selectively movable into a deployed position. Specifically, in that embodiment, the illustrated lid 15*k* includes a movable raised portion that is defined by the second longitudinal end 36*k* of lid 15*k*, which is hingedly coupled at a hinge 55, to a remainder of lid 15*k*. FIG. 15 shows second longitudinal end 36*k* in a first, undeployed position and orientation, that permits lid 15*k* to function as a lid i.e., coupling with tray 14 (FIG. 1) so as to define a container similar to the example container 10 of FIGS. 1 and 2, suitable for containing food items such as sushi in the interior 18 of that container. In the undeployed position shown in FIG. 15, the exterior surface 20*b* of top wall 20 is generally flat. In that illustrated embodiment, the lateral walls 22 include a respective pair of frangible lines 57, that divide each lateral wall 22 into first and second sections 22*m*, 22*p*, with the lateral wall sections 22*m* forming part of second longitudinal end 36*k* of lid 15*k*, and therefore forming part of the deployable raised portion of that lid.

Figure 16:
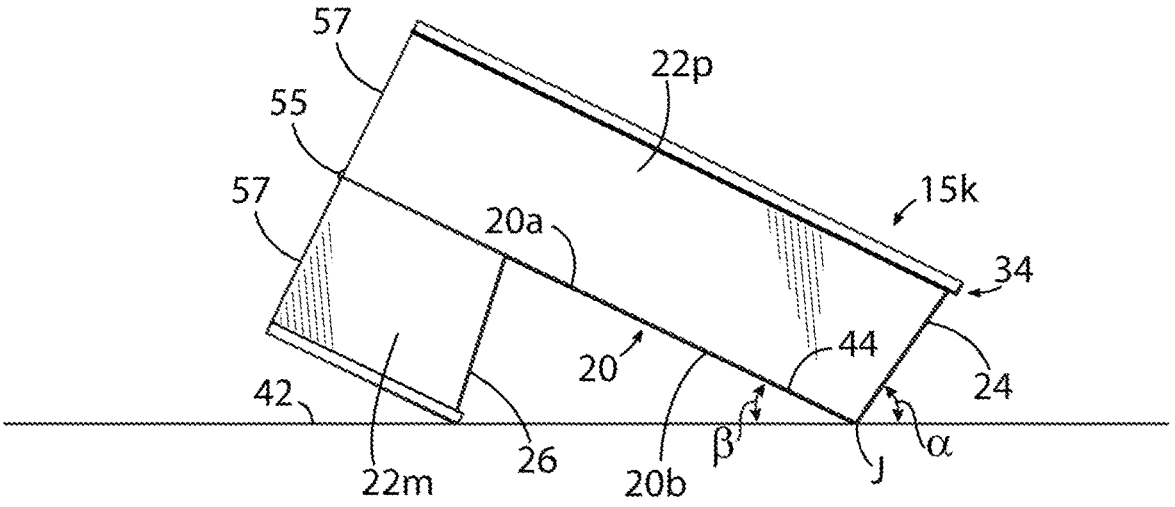
FIG. 16 is a side elevation view of the lid of FIG. 15 turned upside down relative to the view in that figure.

FIG. 16 shows longitudinal end 36*k* in a second, deployed position and orientation, thereby defining the raised portion of lid 15*k*. In the deployed condition of longitudinal end 36*k*, the lateral walls 22 have been broken along frangible lines 57, and longitudinal end 36*k* has been folded into the shown position and orientation about hinge 55. In the deployed condition, lid 15*k* may then be flipped upside down in the manner described in connection with the preceding embodiments, so that—when exterior surface 20*b* is allowed to rest on a flat surface 42, the first end wall 24 and the end portion 44 of interior surface 20*a* jointly define a liquid-holding volume V (FIGS. 4 and 5) having a functionality and capacity similar to those of the preceding embodiments. While not shown explicitly, an alternative embodiment is contemplated in which the shape and orientation of end portion 44 in the embodiment of FIG. 16 is instead similar to end portion 44*b* in the embodiment of FIG. 14.

Figure 17A:
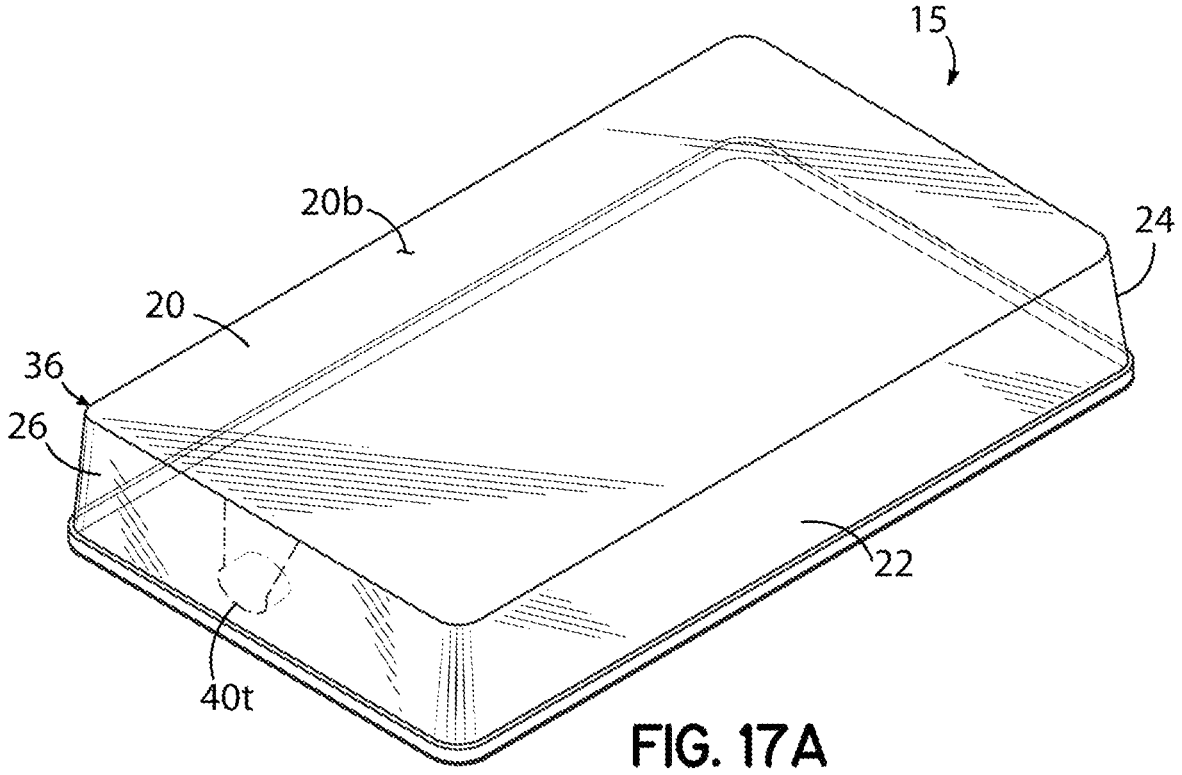
FIG. 17A is a perspective view of a lid in accordance with another embodiment of the invention.
Figure 17B:
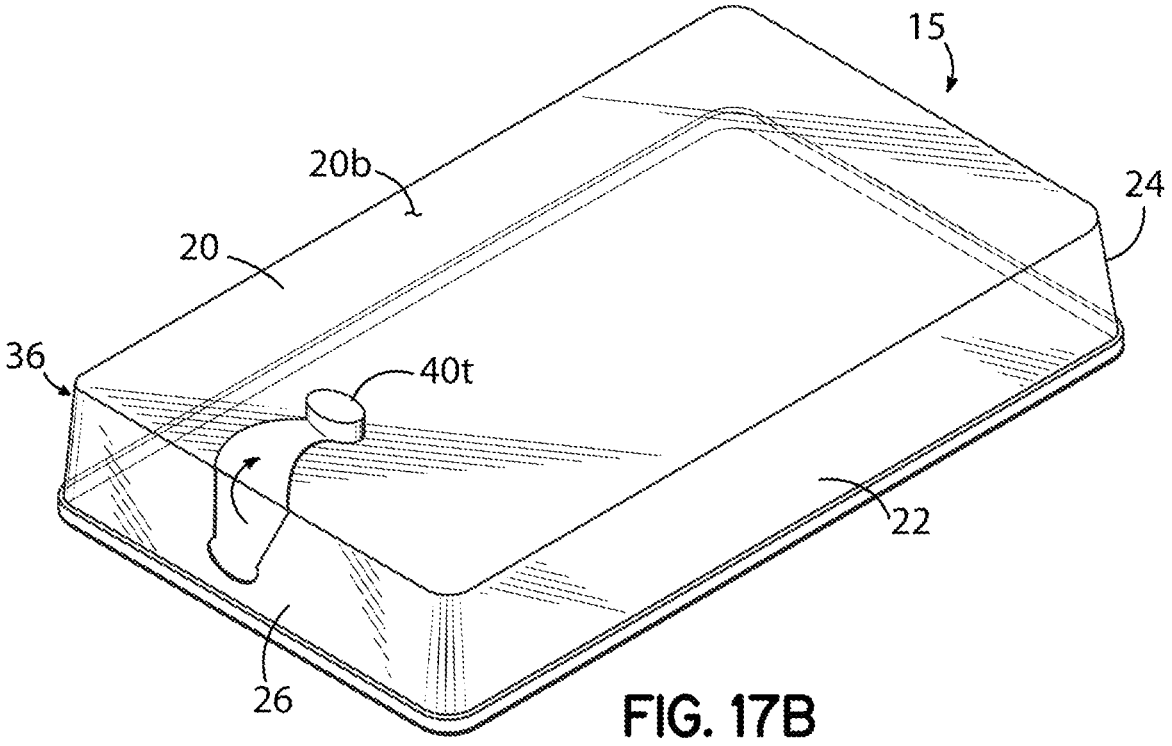
FIG. 17B is a view similar to FIG. 17A, showing deployment of a movable feature of the lid to thereby form a raised portion on an exterior surface of a top wall of the lid.

Other alternative embodiments are contemplated having a movable feature that is deployable between a first condition in which the exterior surface 20*b* of the lid 15 is generally flat, and a second condition in which a raised portion is formed in lid 15, thereby enabling the functionality described above when lid 15 is turned upside down. For example, as shown in FIGS. 17A and 17B, lid 15 may have a movable raised portion in the form of a strap or arm 40*t* that is hingedly connected to a remainder of lid 15, and which is selectively deployed between a first, undeployed position or condition (FIG. 17A), and a second, deployed position or condition that defines a raised portion on exterior surface 20*b*. A generally flat, generally horizontal exterior surface—as in the undeployed condition shown in FIG. 17A—may be desirable to provide lids that may be easily and stably stacked, to thereby facilitate storage of those lids prior to use with a tray for holding and serving food items. In the deployed condition of the movable raised portion 40*t* in that illustrative embodiment, as shown in FIG. 17B, the exterior surface 20*b* is not generally flat.

From the above disclosure of the general principles of the present invention and the preceding detailed description of particular example embodiments, those skilled in the art will readily comprehend the various modifications to which this invention is susceptible. Accordingly, this invention is intended to be limited only by the scope of the following claims and equivalents thereof.

What is claimed is:

1. A container for food, comprising:

a tray having a tray surface configured to support a plurality of food items thereon; and a lid configured for releasable coupling with said tray to define an interior of the container, said lid extending between first and second oppositely disposed longitudinal ends and having one or more sidewalls and a top wall connected to said one or more sidewalls, said top wall having an interior surface facing said interior of the container, and an exterior surface disposed opposite said interior surface, said one or more sidewalls including an end wall located at said first longitudinal end of said lid, said interior surface including an end portion adjacent said end wall, wherein:

said lid is made of a food-grade material, said lid has at least one of a preformed raised portion on said exterior surface or a deployable element for defining a raised portion on said exterior surface, said raised portion is shaped and located in said lid such that when said lid is flipped upside down and said exterior surface is allowed to rest on a flat surface, at least a portion of said interior surface located between said raised portion and said end wall is oriented so as to define an acute angle relative to the flat surface, measured exteriorly of said lid, said lid has a generally rectangular shape when viewed from above and an entirety of said top wall is substantially transparent, said end wall defines an angle greater than about 90 degrees relative to said top wall at said first longitudinal end of said lid, and said end wall and said end portion of said top wall interior surface jointly define a liquid-holding volume of at least about 10 mL with a depth of at least about 4 mm when said lid is flipped upside down and said exterior surface is allowed to rest on a flat surface.

2. The food container of claim 1, wherein said raised portion is shaped and located in said lid such that when said lid is flipped upside down and said exterior surface allowed to rest on a flat surface, said end portion of said interior surface is oriented so as to define an acute angle relative to the flat surface, measured exteriorly of said lid.

3. The food container of claim 1, wherein said raised portion is movable between an undeployed position in which said exterior surface of said top wall of said lid is generally flat, and a deployed position in which said exterior surface of said top wall of said lid is not generally flat.

4. The food container of claim 3, wherein said raised portion includes a portion of each of a pair of said sidewalls, said portions of said pair of sidewalls being joined to a remainder of said lid through a respective pair of frangible lines.

5. The food container of claim 3, wherein said raised portion is hingedly coupled to a remainder of said lid.

6. The food container of claim 1, wherein said raised portion is shaped and located in said lid such that when said lid is flipped upside down and said exterior surface is allowed to rest on a flat surface, said end wall is oriented at an acute angle of less than about 85 degrees relative to the flat surface, measured exteriorly of said lid.

7. The food container of claim 1, wherein said end portion of said top wall interior surface defines a depression of said top wall interior surface relative to a remainder of said top wall interior surface.

8. The food container of claim 1, wherein when said lid is flipped upside down and said exterior surface is allowed to rest on a flat surface, said end portion of said top wall interior surface is generally parallel to the flat surface.

9. The food container of claim 1, wherein said raised portion defines a protrusion extending from a remainder of said exterior surface of said top wall.

10. The food container of claim 1, wherein said raised portion is located adjacent said second longitudinal end of said lid.

11. The food container of claim 10, wherein said lid includes at least two raised portions on said exterior surface, both located adjacent said second longitudinal end of said lid.

12. The food container of claim 10, wherein said raised portion is defined by an inclined surface extending from said second longitudinal end of said lid.

13. A sushi container comprising:

a tray having a tray surface configured to support a plurality of sushi items thereon; and a lid configured for releasable coupling with said tray to define an interior of the sushi container, said lid having one or more sidewalls and a top wall connected to said one or more sidewalls, said top wall having an interior surface facing said interior of the sushi container, and an exterior surface disposed opposite said interior surface, said one or more sidewalls including an end wall located at a first longitudinal end of said lid, wherein:

said lid is made of a food-grade material, said lid has a generally rectangular shape when viewed from above and an entirety of said top wall is substantially transparent, said end wall defines an angle greater than about 90 degrees relative to said top wall at said first longitudinal end of said lid, said lid has at least one of a preformed raised portion on said exterior surface or a deployable element for defining a raised portion on said exterior surface, said raised portion is shaped and located in said lid such that when said lid is flipped upside down and said exterior surface is allowed to rest on a flat surface, said end wall and an end portion of said top wall interior surface adjacent said end wall are both oriented so as to define an acute angle relative to the flat surface, measured exteriorly of said lid, and said end wall and said end portion of said top wall interior surface jointly define a holding volume for soy sauce of at least about 10 mL with a depth of at least about 4 mm, and said raised portion and a remainder of said exterior surface of said top wall are configured to substantially prevent rocking of said lid when said lid is flipped upside down and said exterior surface is allowed to rest on a flat surface.

14. The sushi container of claim 13, wherein said exterior surface includes an elongated depression configured to support a pair of chopsticks therein.

15. A lid for use with a tray to enclose food items, comprising:

one or more sidewalls;

a top wall connected to said one or more sidewalls, said top wall having an interior surface delimited by said one or more sidewalls, and an exterior surface disposed opposite said interior surface, said one or more sidewalls including an end wall located at a first longitudinal end of the lid; and at least one of a preformed raised portion on said exterior surface or a deployable element for defining a raised portion on said exterior surface, wherein:

the lid is made of a food-grade material, said raised portion is shaped and located in the lid such that when the lid is flipped upside down and said exterior surface is allowed to rest on a flat surface, at least a portion of said interior surface located between said raised portion and said end wall is oriented so as to define an acute angle relative to the flat surface, measured exteriorly of the lid, the lid has a generally rectangular shape when viewed from above and an entirety of said top wall is substantially transparent, said end wall defines an angle greater than about 90 degrees relative to said top wall at said first longitudinal end of the lid, and said end wall and said end portion of said top wall interior surface jointly define a liquid-holding volume of at least about 10 mL with a depth of at least about 4 mm when the lid is flipped upside down and said exterior surface is allowed to rest on a flat surface.

16. The food container of claim 1, wherein said tray is generally shallow.

17. The food container of claim 1, wherein said lid has a height that is greater than a height of said tray.

18. The food container of claim 1, wherein said raised portion defines a contacting surface for contacting the flat surface when said lid is flipped upside down and allowed to rest on that flat surface, said contacting surface being non-convex.

19. The food container of claim 1, wherein said raised portion defines a contacting surface for contacting the flat surface when said lid is flipped upside down and allowed to rest on that flat surface, said contacting surface being linear.

20. The food container of claim 15, wherein said raised portion defines a contacting surface for contacting the flat surface when the lid is flipped upside down and allowed to rest on that flat surface, said contacting surface being non-convex.

* * * * *